US010329115B2

(12) United States Patent
Licata

(10) Patent No.: US 10,329,115 B2
(45) Date of Patent: Jun. 25, 2019

(54) SPEEDY BAG—BAG DISPENSING SYSTEM

(71) Applicant: Jack Joseph Licata, Bernardsville, NJ (US)

(72) Inventor: Jack Joseph Licata, Bernardsville, NJ (US)

( * ) Notice: Subject to any disclaimer, the term of this patent is extended or adjusted under 35 U.S.C. 154(b) by 0 days.

(21) Appl. No.: 13/844,644

(22) Filed: Mar. 15, 2013

(65) Prior Publication Data

US 2014/0263532 A1 Sep. 18, 2014
US 2018/0057300 A9 Mar. 1, 2018

Related U.S. Application Data

(63) Continuation-in-part of application No. 13/462,599, filed on May 2, 2012, now Pat. No. 8,522,999, which is a continuation of application No. 12/685,667, filed on Jan. 11, 2010, now Pat. No. 8,191,724, which is a continuation-in-part of application No. 11/140,178, filed on May 31, 2005, now Pat. No. 7,669,728.

(51) Int. Cl.

*B65H 3/10* (2006.01)
*B65H 35/10* (2006.01)
*B65F 1/06* (2006.01)

(52) U.S. Cl.

CPC ..... *B65H 35/10* (2013.01); *B65F 1/062* (2013.01); *B65H 2701/191* (2013.01); *Y10T 225/393* (2015.04)

(58) Field of Classification Search

CPC ..... A47K 10/00; A47K 10/24; A47K 10/32; A47K 10/3266; A47K 10/42; A47K 10/421; B65D 3/00; B65D 5/00; B65D 5/48; B65D 5/54; B65D 31/00; B65D 1/06; B65D 25/00; B65D 25/16; B65D 25/14; B65H 1/00; B65H 1/02; B65H 1/04; B65H 1/06; B65H 55/00; B65H 35/10; B65H 2701/191; B65F 1/062; Y10T 225/393; Y10T 225/30; Y10T 83/889; Y10T 83/896; Y10T 83/902

USPC ..... 225/106, 93; 83/648–650; 221/33, 34, 221/63, 26, 27, 45, 92; 206/397, 401; 220/500, 501, 503, 4.01, 4.07, 98, 495.06, 220/495.07

See application file for complete search history.

(56) References Cited

U.S. PATENT DOCUMENTS

| | | | | |
|---|---|---|---|---|
| 4,570,304 | A * | 2/1986 | Montreuil et al. | 24/30.5 S |
| 4,849,090 | A | 7/1989 | Case et al. | |
| 5,183,157 | A * | 2/1993 | Darden | 206/390 |
| 5,353,950 | A | 10/1994 | Taylor et al. | |
| 5,564,762 | A | 10/1996 | Ring | |
| 5,671,847 | A * | 9/1997 | Pedersen et al. | 206/554 |
| 5,738,239 | A * | 4/1998 | Triglia | 220/495.07 |
| 6,007,403 | A * | 12/1999 | Urspringer et al. | 446/222 |
| 7,168,591 | B1 | 1/2007 | Miller | |
| 7,669,728 | B2 * | 3/2010 | Licata | 220/495.01 |
| 2005/0172529 | A1 * | 8/2005 | Bourgoin et al. | 40/359 |

(Continued)

*Primary Examiner* — Phong H Nguyen
(74) *Attorney, Agent, or Firm* — Harold G. Furlow, Esq

(57) ABSTRACT

A bag dispensing apparatus is described that comprises a container that includes a box and a series of garbage bags. The box includes a top and the top defines an opening. The last bag of the series of garbage bags connects a cut in a plate positioned in the container. When the last bag is pulled from a trash can the last bag pulls the container and plate from the trash can. The container and plate can then be separated from the last bag and recycled.

20 Claims, 15 Drawing Sheets

(56) References Cited

U.S. PATENT DOCUMENTS

| | | | | |
|---|---|---|---|---|
| 2007/0023442 | A1* | 2/2007 | Auzenne | 220/801 |
| 2008/0011910 | A1* | 1/2008 | Ramsey | 248/100 |

* cited by examiner

FIG 5
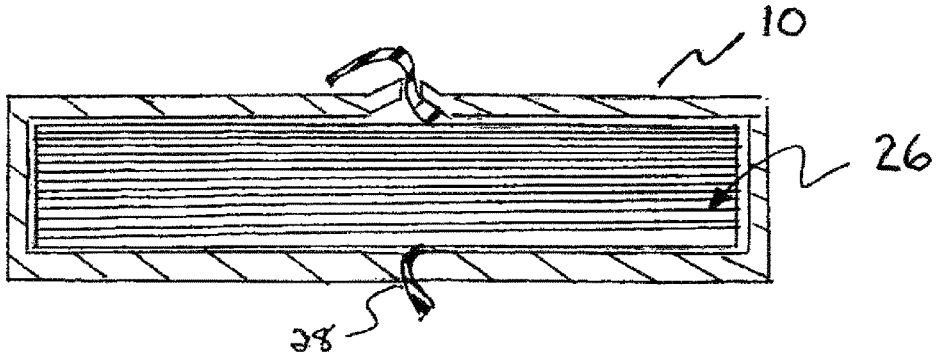
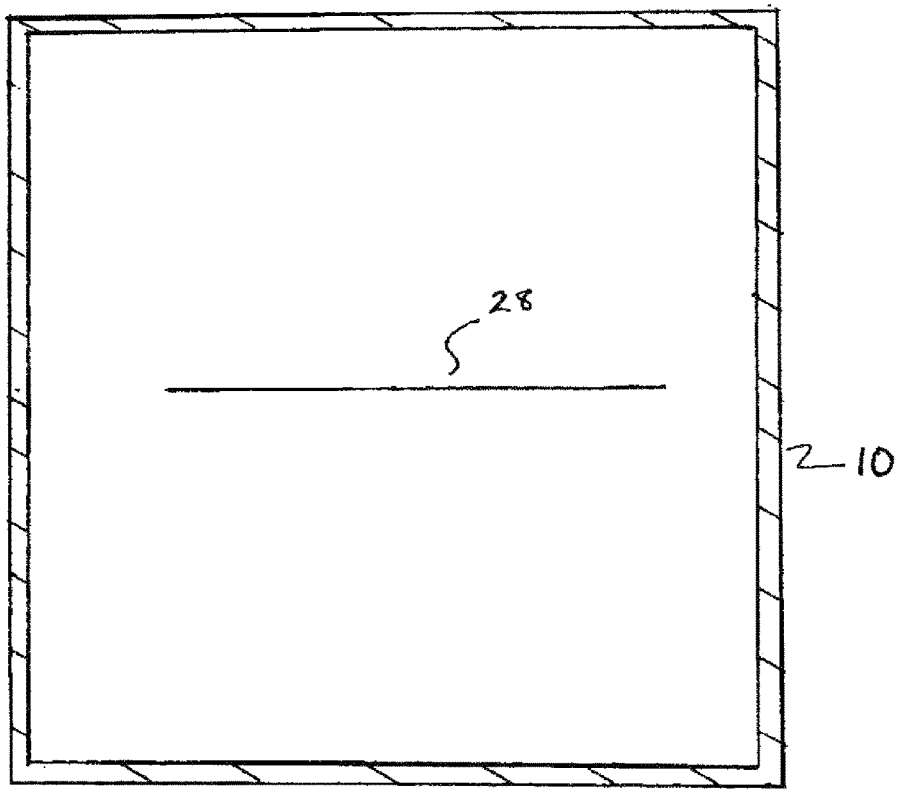
FIG 6

SPEEDY BAG—BAG DISPENSING SYSTEM

CROSS-REFERENCE TO RELATED APPLICATIONS

This application is a continuation in part of U.S. patent application Ser. No. 13/462,599 filed May 2, 2012 that is a continuation of and claims priority to U.S. patent application Ser. No. 12/685,667 filed on Jan. 11, 2010 that was a continuation in part of, claims priority to and the benefit of U.S. patent application Ser. No. 11/140,178 filed on May 31, 2005 that claims priority to and the benefit of provisional application 61/207,831 filed Feb. 18, 2009 and, the disclosures of which are incorporated by reference herein and made a part of this application.

BACKGROUND OF THE INVENTION

Field of the Invention

This disclosure relates to structures that dispense bags and in particular to a structure that can dispense bags from a bottom of a trash receptacle.

Description of the Related Art

Trash bags are mainly used to line a trashcan type receptacle. The problem is the liners are never near the receptacle and someone has to retrieve a liner from a remote location to complete the function, too much time and too many man hours are wasted in this process.

Many people in a residential or commercial application will store several extra bags in the bottom of the trashcan receptacle as a means to speed up the entire cycle of changing trashcan liners. In an industrial cleaning, health care, or fast food application the time and cost factor for this process is significant.

Many times this job has been delegated to people with handicaps or mental illness. A more efficient, easier, cleaner, and less cumbersome way of having these bags readily available has been needed for some time.

SUMMARY OF THE INVENTION

The present disclosure describes a system or apparatus which is convenient and economical for packaging, deploying, and distributing plastic bags, primarily, but not exclusively in the waste arena. The invention puts bags at the source of where they are being used. For example, in the waste industry the Speedy Bag System will be in the bottom of the receptacle, when the full bag is removed the next one to replace it is automatically discharged and ready to line the receptacle. This speeds up the process of relining the receptacle, rather than taking the extra steps to find a replacement bag that may be in a remote location like a back storeroom or cleaning cart.

Because the bags are connected at a point of weakness and packed sequentially, the next bag to be used follows the full bag being removed. After all but the last bag are used up, the last bag is attached to the container through a score in the underside of the container causing the said container to follow the last bag out of the receptacle as the last bag is removed. The container can be disposed of, recycled, or refilled.

Then a new Speedy Bag System is put into the bottom of the receptacle so that a large number of bags in a protected container will remain at the bottom of the trash receptacle for the process to be repeated.

In another embodiment, the bag dispensing apparatus comprises a container and a series of bags. The container includes a box that has a plurality of walls that define an enclosure. One of the walls defines a restricted opening. The container includes opposing walls and two of said opposing walls include connectors. A core is included with the container that attaches to the connectors. The core includes a plurality of hingedly connected plates. The connectors provide for the rotational movement of the core relative to the box. A series of bags are connected in sequence and wound around the core. The core receives and connects to the terminal end portion of a last bag of the series of bags. The core is rollable, or can be rolled, from a first planar position to a second position in which the core has an angled spiral coil shape. The second position defines a crimped connection with a terminal end portion of a last bag.

The series of bags is sequentially removable through the opening in the container. There is a line of weakness between each pair of adjacent bags to permit ease of separation between adjacent bags. The last bag and subsequent bags are rolled around the core to define the series of bags. A first position of the last bag includes the attachment between the last bag and core removing the container with the last bag. The last bag is optionally movable to a second position that includes the last bag separating from the container. When separated from the last bag, the container is suitable for refilling with the series of bags.

The connectors on the opposing walls of the container are circular notches and each notch receives a terminal end portion of the core. The crimp connection of the core includes inner and outer plates. The inner plate is outwardly biased and the outer plate is inwardly compressed to define a crimping connection on the distal end portion of the last bag. The container is a rectangular box that has four folded sides. The area covered by three of said sides being large enough to permit entry into the box of the series of bags and positioning of the terminal end portion of the core of the series of bags into the connectors in two opposing sides of the box.

The bag dispensing apparatus can also comprise a container that includes a box that has a plurality of walls. The walls define an enclosure that has a restricted opening defined in one of the walls. The box has an approximately rectangular shape that includes two opposed elongate first sidewalls and two opposed second sidewalls. The opposed second sidewalls each include a notch. A core connects to the notches in the container. The notches provide for rotational movement of the core relative to the box. The core includes a plurality of panels that are biased to a first position. A series of bags includes a plurality of bags that are connected in sequence. The core crimps the last bag of the series of bags between two of panels. The last bag and the subsequent bags of the series of bags are rolled around the core. The series of bags are sequentially removable through the opening in the container. A line of weakness is positioned between each pair of adjacent bags that permits ease of separation between of the adjacent bags. The apparatus, is adapted for positioning on a bottom of a trashcan. Each bag of the series of bags is deployable from the container positioned on the bottom of the trashcan and each bag is adapted to extend from the container around a rim of an opening of the trashcan. The removing, of each bag unwinds a subsequent bag from the core. The last bag of the series of bags is adapted to remove the container when the last bag is removed from the trashcan. The last bag is optionally separable from the container. The container is separated from the last bag and is optionally refillable with the series of bags.

The container rests on the bottom of the trash can solely by the weight of the container and series of bags. The container is a rectangular shaped box that has four folded sides. The area covered by three of the is large enough to permit the positioning of the core of the series of bags into the notches. The opening has a first length and the core has a second length. The length of the core is greater than the length of the opening.

An additional bag dispensing apparatus comprises a container that includes a box that has a plurality of walls. The walls define an enclosure that includes a restricted opening in one of the walls. The container is an approximately rectangular shaped box. A series of bags is included in the container. The series of bags are connected in sequence. A core connects to the last bag of the series of bags. The last bag and the subsequent bags of the series of bags are rolled around the core. The series of bags is sequentially removable through said opening in the container. A line of weakness is positioned between each pair of adjacent bags that permits ease of separation between adjacent bags. The apparatus is adapted to roll the core and bags together to form the container. The core has a first planar position and includes a plurality of hingedly connected panels. The core rolls into a second position that crimps a last bag. The continued rolling of the core winds the series of bags into a roll. The removing of each bag unwinds a subsequent bag from the core. The last bag is adapted to remove the container when removed from a trashcan. The last bag is optionally separable from the container. The container is separable from the last bag and is optionally refillable with the series of bags.

Other details and advantages of the invention will become apparent with the following description of the embodiment and accompanying drawings.

BRIEF DESCRIPTION OF THE DRAWINGS

FIG. 5 shows a side section of the container with the first bag protruding through the top opening and the last bag protruding through the score on the underside;

FIG. 6 shows the underside of the container with score line;

DESCRIPTION OF ILLUSTRATED EMBODIMENTS

Figure 1:
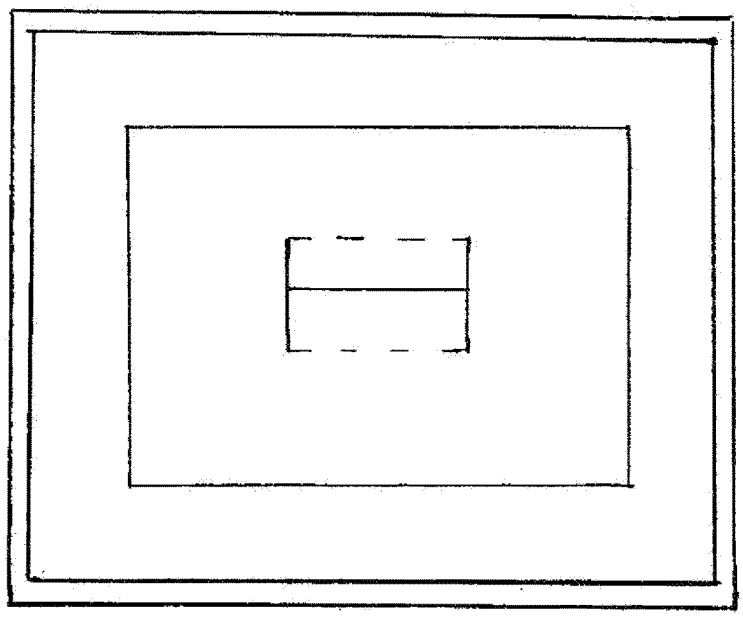
FIG. 1 shows a top view looking down into a trashcan at an unopened container of trash bags lying at the bottom of the trashcan.

Referring now more particularly to the drawings, there is shown a plan view FIG. 1. of a container holding the bags 10, resting in the bottom of a trashcan 12. The container 10 has on its top an opening 16, with two hinged doorways 18, causing the doors to fold outward from the center opening 16.

Figure 2:
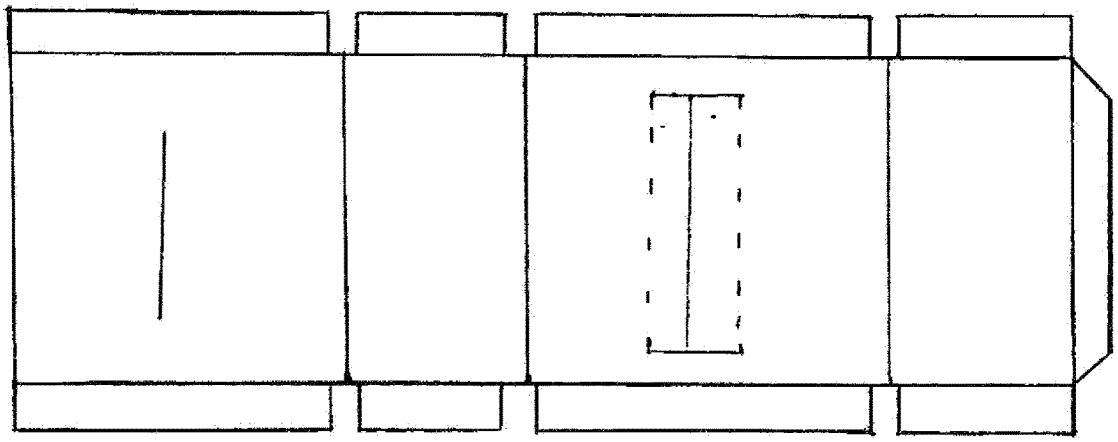
FIG. 2 is a view, in reduced scale, of a blank to form container laid out flat before it is erected.

FIG. 2. is a view of the container blank laid out flat. It has the hinged doors 18, and the cuts in the top 17, and two perforated sides 19, acting as hinges for the opening. The score 28, is what has the last bag attach to the container 10.

Figure 3:
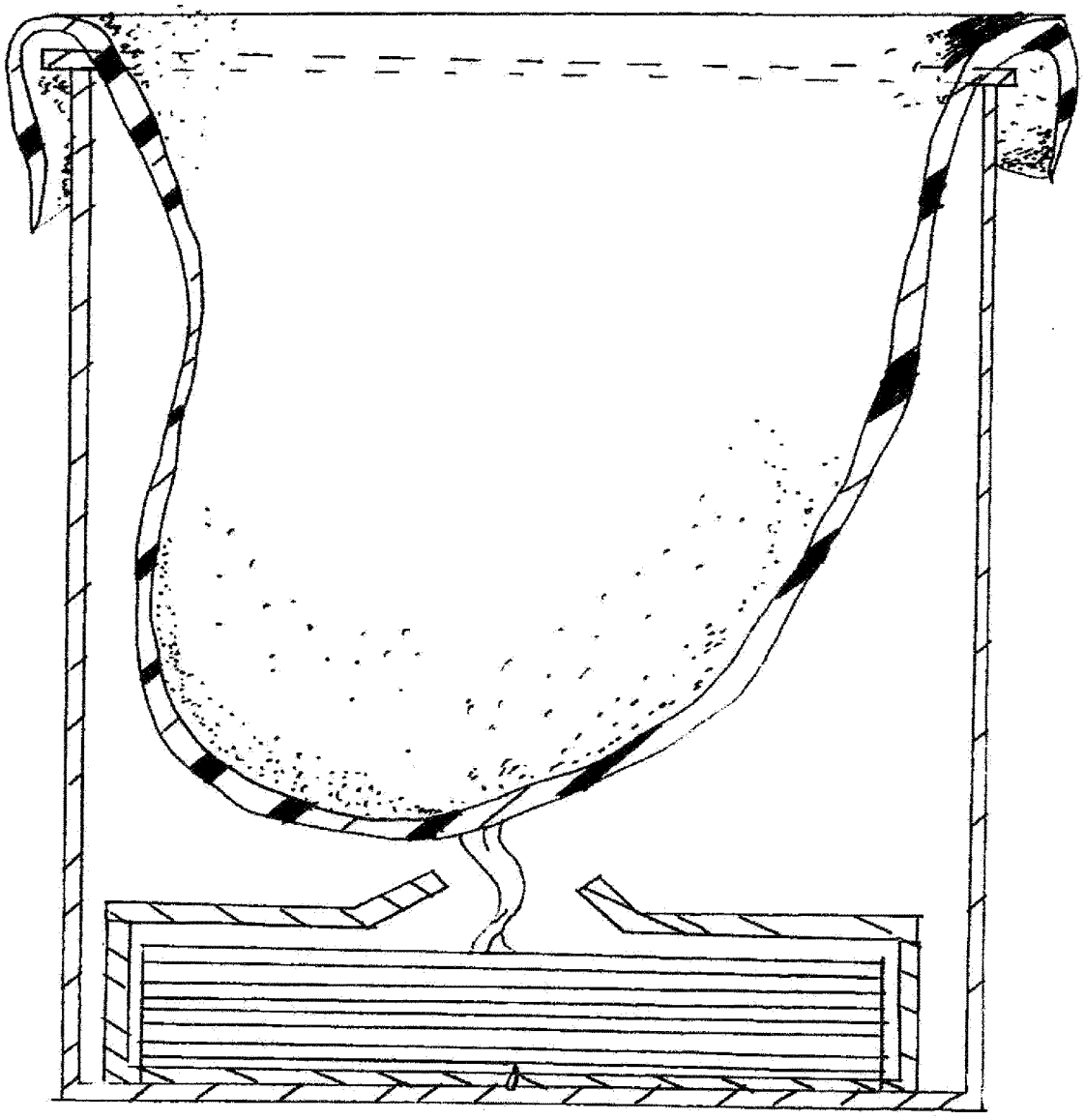
FIG. 3. shows a section corresponding to FIG. 1 of what it looks like after the container has been opened and a bag has been deployed from the container.

FIG. 3. encompasses the entire system in action where we see container 10 positioned on the bottom of the trashcan 22, a deployed bag 20 is dispensed from container 10 and bag 20 is secured around the top lid of the trashcan 22. The next sequential bag 24 is attached at the bottom of the deployed bag 20 by tear lines in the form of perforations 25, extending transversely between them. The remaining bags in the box 26 are similarly attached to each other. The last bag 27 is fed approximately ½1" through the score line in the underside of the container which then secures the bags to the container 10. Container 10 is positioned directly on the bottom of trashcan 12 and uses neither adhesives nor any other form of device to retain container 10 on the bottom of trashcan 12. The last bag 27 extending from the score line also does not include any adhesives or any other devices to retain the last bag 27 on the bottom of trashcan 12.

Figure 4:
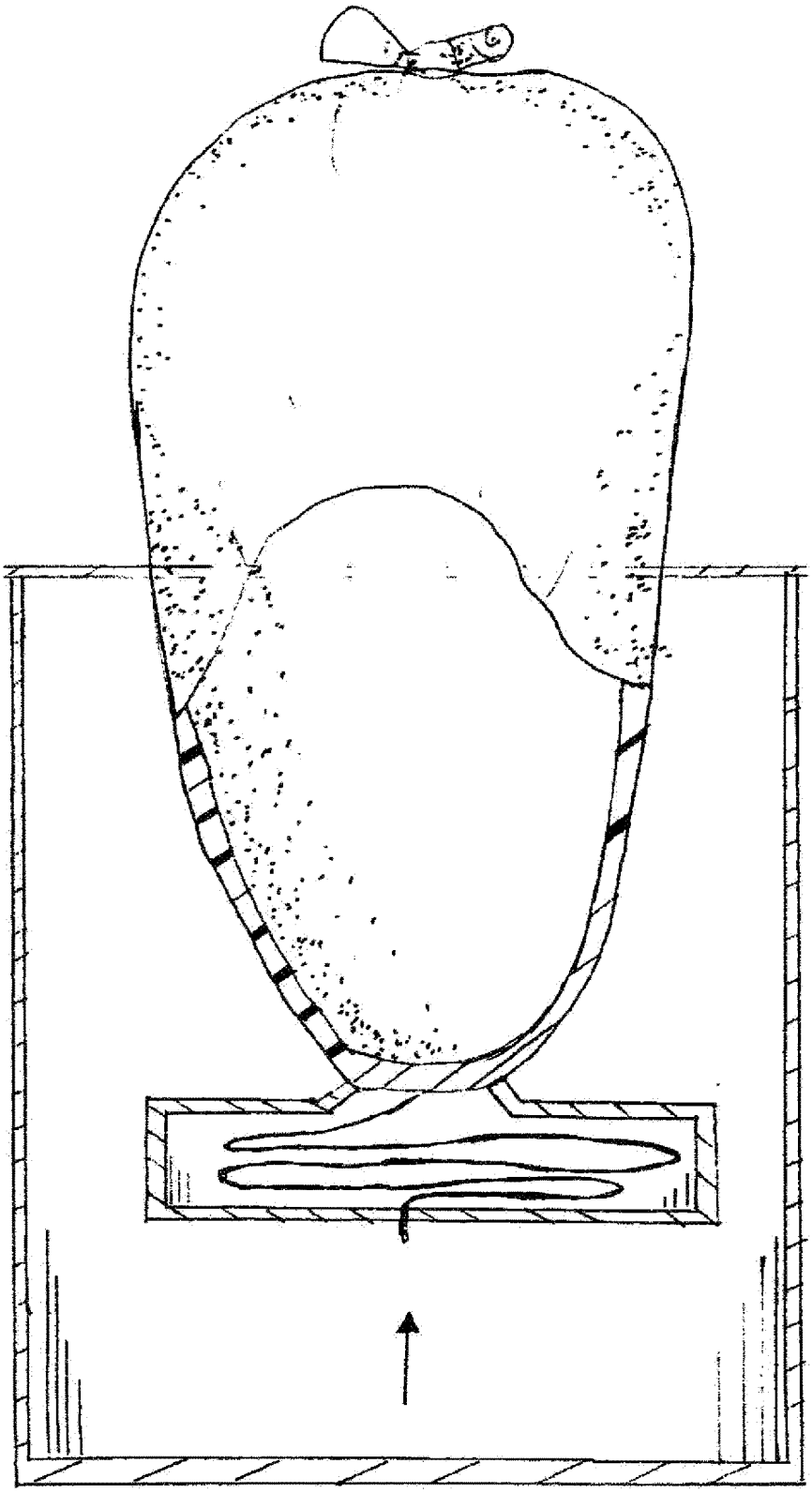
FIG. 4 shows a sectional view corresponding to FIG. 1 but showing the last bag attached to the bottom panel and protruding through the score in the container and pulling up the container in the receptacle.

FIG. 4. is a more precise view of the end of the system after all but the last bag have been used and this last bag 27, is full of trash, tied at the top 30, and being removed from the trashcan 12. The score 28, holds the last bag 27, the container 10, causing the container to be pulled up with the last bag out of the trashcan 12.

FIG. 5. is a section view of the full container 10, with the nested bags 26, and the score line 28, with the last bag 27, protruding from the lower flap.

FIG. 6. is a plan view of a container 10, bottom view showing the score line 28.

Figure 7:
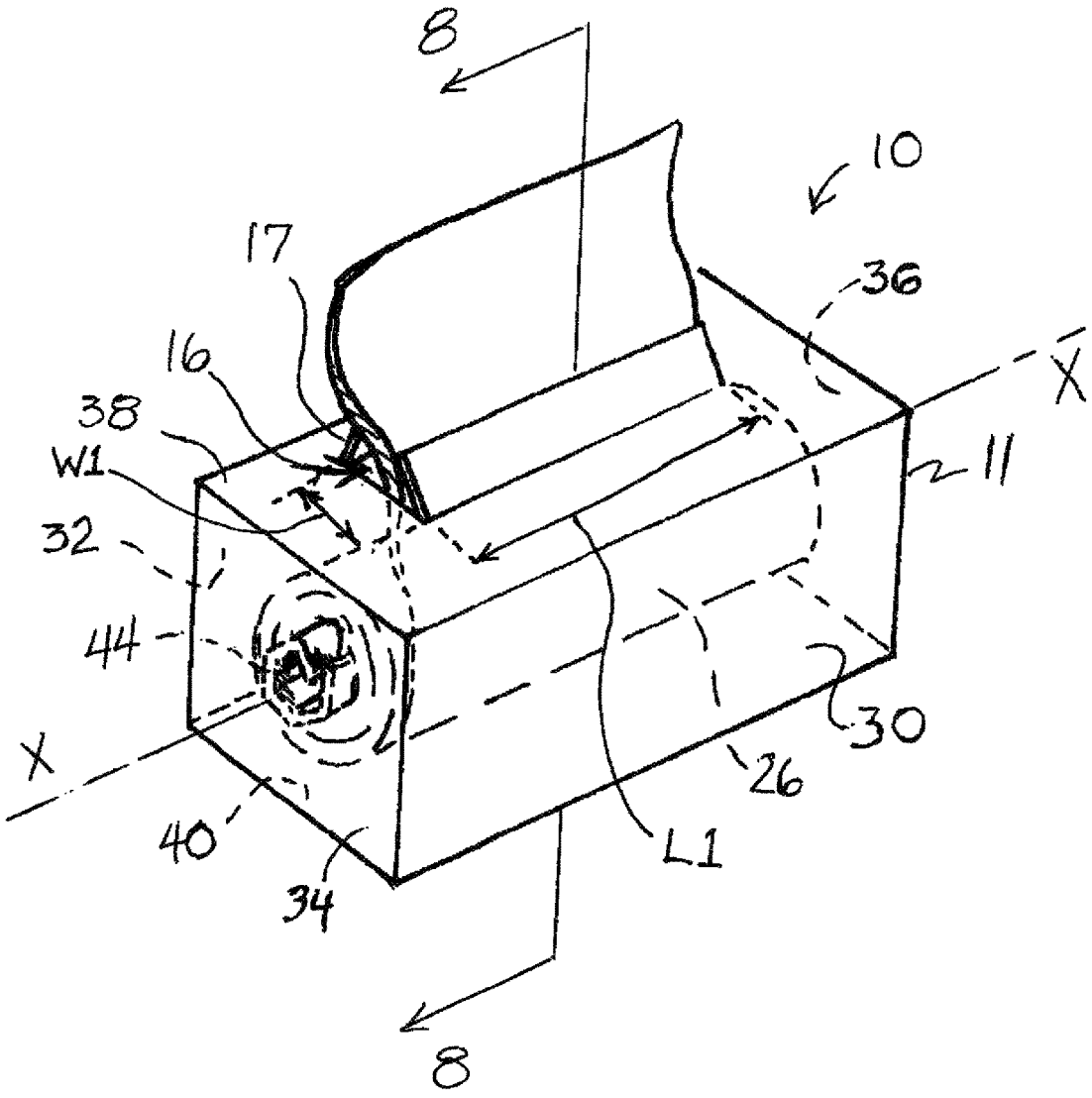
FIG. 7 is a front, side and top perspective view of a second embodiment of the container of trash bags of FIG. 1 with one bag partially deployed from the container, the container constructed in accordance with the present disclosure.

FIG. 7. is a second embodiment of the present disclosure. Container 10 is preferably a rectangular shaped box 11 that includes a first wall 30 opposed by a second wall 32, a third wall opposed 34 opposed by a fourth wall 36 and a fifth wall 38 opposed by a sixth wall 40. In this exemplary box, the first, second, fifth and sixth walls have a first length and the third and fourth walls have a second length that is less than the first length. Container 10 defines a central longitudinal axis-X that is approximately aligned with first wall 30, second wall 32, fifth wall 38 and sixth wall 40. Second wall 34 and third wall 36 are approximately perpendicular to the longitudinal axis.

Fifth wall 38 is shown as the top wall and includes cuts 17 that define top opening 16 as described previously. Sixth wall 40 is the bottom wall and is a solid wall that does not define an aperture to include a score or slit. Third wall 34 and fourth wall 36 are end walls. Nested or series of bags 26 is positioned in box 11 of container 10. Series of bags 26 are wound around a core 44.

Figure 8:
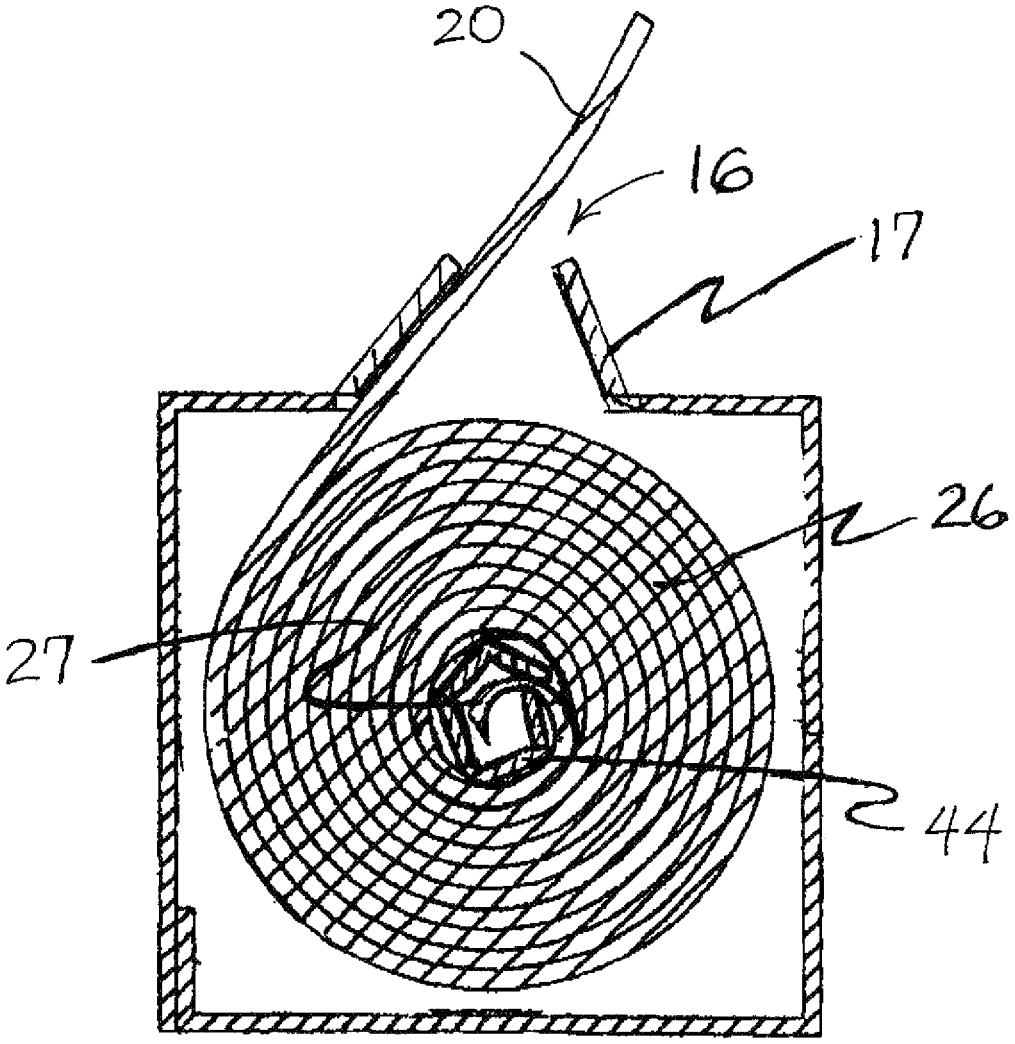
FIG. 8 is a side cross-sectional view taken along lines 8-8 of FIG. 7 that shows the series of bags wound around a core.

FIGS. 7 and 8. In this preferred embodiment, container 10 includes nested or series of bags 26 that are a combined assembly of the bags rolled around a core 44. End walls 34 and 36 include a connector 42 that couples with core 44 and provides for the rotation of core 44 relative to box 11. The at least partially deployed bag 20 extends through opening 16 defined by cut 17 in top 38 of container 10.

Core 44 is an elongate member that connects to last bag 27. Core 44 engages last bag 27 and subsequent bags, connected in series at a point of weakness as described previously. Last bag 27 and subsequent bags are rolled onto core 44 to form nested or series of bags 26. Outermost bag 20 is the first bag to be deployed from core 44.

Figure 9:
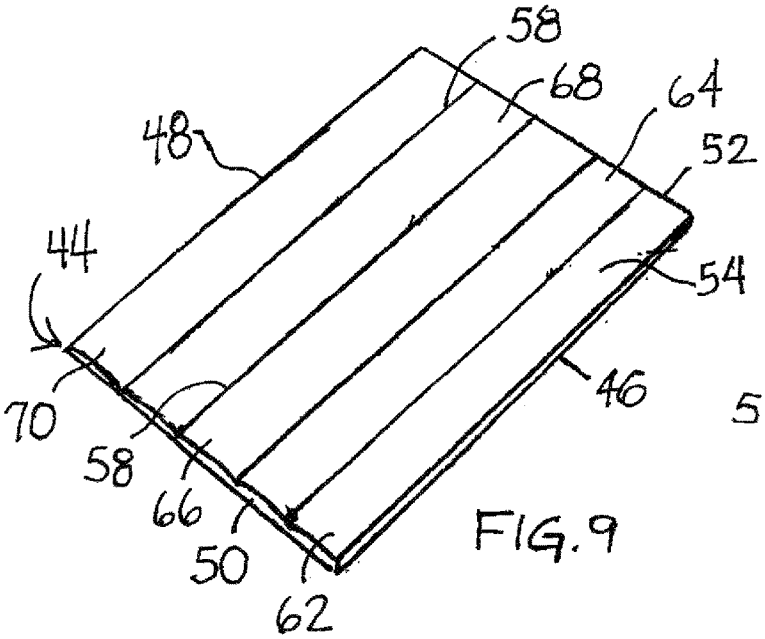
FIG. 9 is a side, front and top perspective view of the core of FIG. 8 in a first position.

FIG. 9. Core 44 is an approximately rectangular plate in a first position. Core 44 includes a first edge 46, a second edge 48 opposed to first edge 46, a third edge 50, and a fourth edge 52 opposed to the third edge 50. First edge 46 and second edge 48 have a third length and third edge 50 and fourth edge 52 have a fourth length that is less than the third length. Core 44 is preferably made of a wood-based recycled or recyclable product such cardboard.

Figure 10:
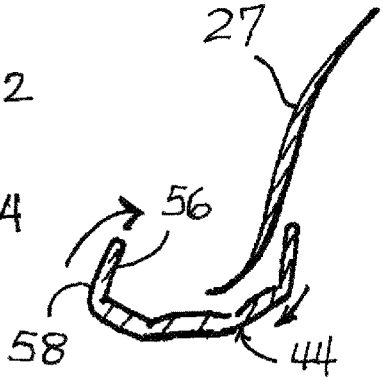
FIGS. 10-12 are side views of the core and last trash bag that shows the steps of flexing the core to the second position of a crimped last bag of the series of bags.

Core 44 has a first approximately planar side 54 and a second approximately planar side 56 (see FIG. 10). First planar side 54 includes a plurality of scores 58 that are approximately parallel to edges 46 and 48 and define approximately five elongate plates. In this preferred embodiment of core 44 there are four scores 58 that define five plates 62, 64, 66, 68 and 70. It is understood that the number of scores 58 and the plates can vary depending upon the intended application of core 44. Scores 58 provide a hinge type rotating interface between the plates and bias core 44 to the first position. As a result of scores 58, core 44 is rollable or can be rolled from the flat planar shape in the first position to an angular spiral coiled position in the second position with at least two plates overlapping one another. Scores 58 can include lines of compression or partial cuts that facilitate the relative rotation of individual plates.

Figures 11, 12:
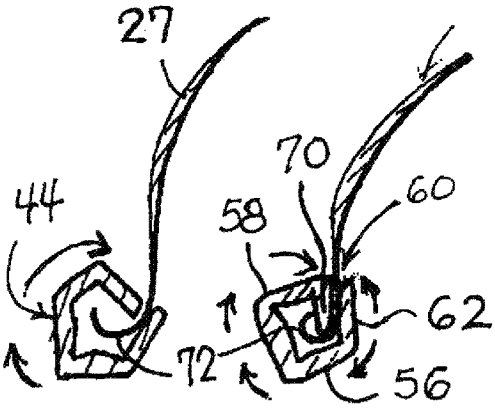

FIGS. 10-12. show the sequential steps of core 44 from the first planar position of FIG. 9 to a second position in FIG. 12. Scores 58 are constructed to facilitate the rolling of the plates of core 44 from the first position through the intermediate positions that include the approximately cupped position in FIG. 10 that can receive bottom end portion 72 last bag 27 and a curled position in which core 44 has at least partially closed on end portion 72. In a second position of core 44, the plates are rolled such that a terminal end portion 72 of last bag 27 is positioned between at least partially overlapping plates 62 and 70 which form a crimp type connection or crimp 60 on bottom end portion 72.

Figure 13:
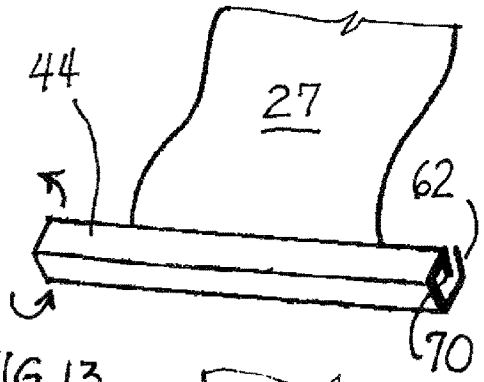
FIGS. 13 and 14 are front, side and top perspective views of the core and last bag of FIG. 12 that show the winding the trash bags onto the core.
Figure 14:
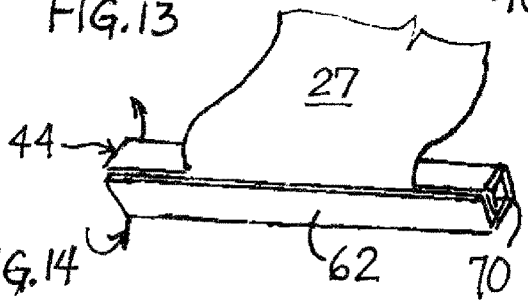

FIGS. 9, 13 and 14. Core 44 in the second position has an angled spiral coil cross-section perpendicular to the longitudinal axis (see FIG. 1) that is approximately square and crimps last bag 27 between plates 62 and 70. The crimp connection 60 of the core 44 at least includes inner plate 70 and outer plate 62, the inner plate 70 is outwardly biased as a result of scores 58 and outer plate 62 is inwardly compressed by the ongoing rolling of last bag 27 to crimp the distal end portion of the last bag.

The continued rotation of core 44 in the second position from the first position continues to wind the remainder of the sequential bags around core 44.

Figure 15:
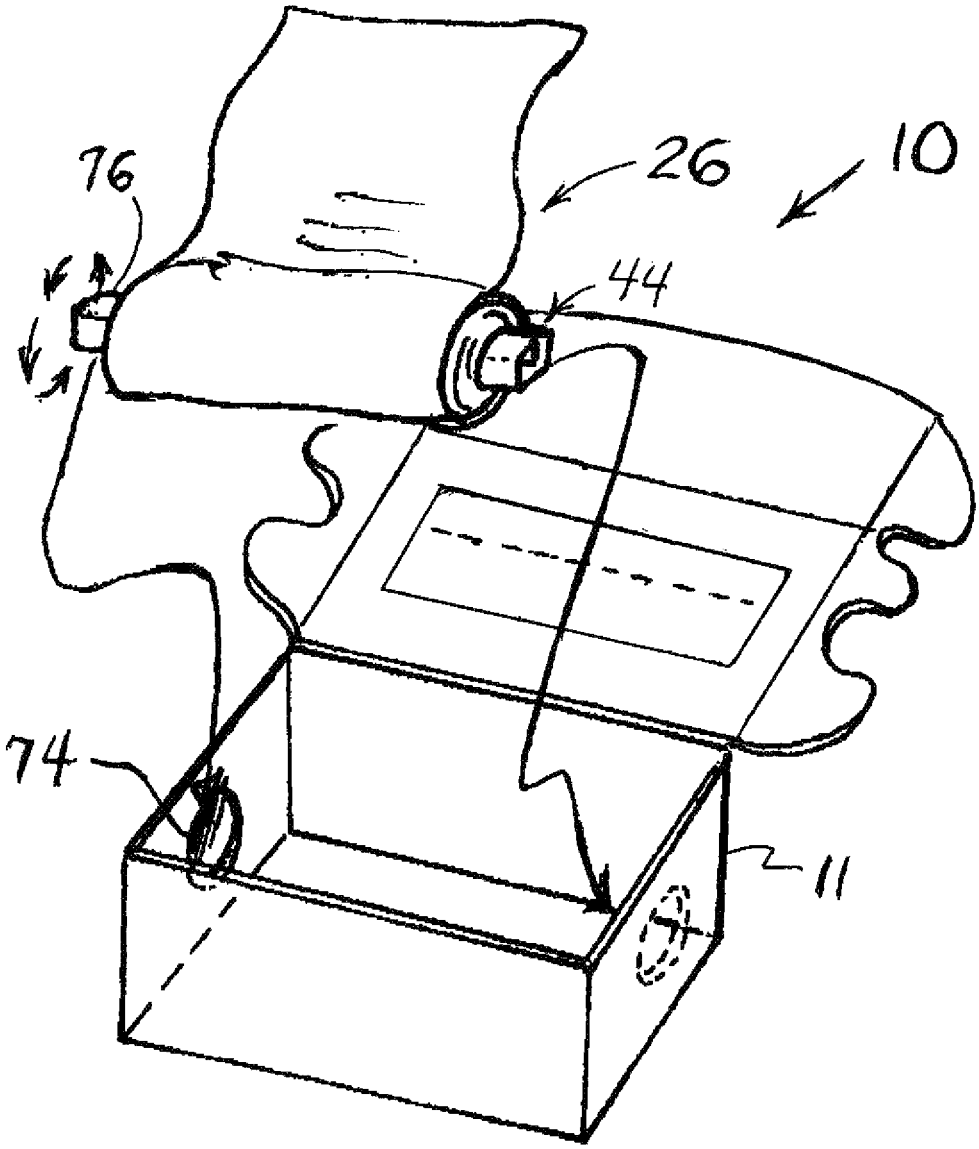
FIG. 15 is a front, side and top perspective exploded view of the container of trash bags of FIG. 7 that shows the container and a series of trash bags.

FIG. 15. Box 11 of container 10 is shown with series of bags 26 removed. Third wall 34 and fourth wall 36 define connectors 74 that are approximately aligned with the longitudinal axis (see FIG. 1) and interface with core 44. Connectors 74 are preferably circular notches defined in the surface of the inside of third wall 34 and fourth wall 36, but it is understood that connector 74 can have alternative structures such as an aperture, an axel or a separate support structure that connects to box 11, for example. Core 44 has opposed terminal end portions 76. The circular notches of connectors 74 receive the approximately square cross-sectioned terminal end portions 76. The terminal end portion 76 to connector 30 interface provides for the rotation of core 44 relative to box 11. The combined series of rolled bags 26 on core 44 is attached to connectors 74 and box 11 is closed to complete the assembly.

Alternatively, series of bags 26 with core 44 can be positioned within box 11 without receptacles 30. Series of bags 26 can rotate within the preferably elongate rectangular box 11 of container 10 and deploy bags. Core 44 has a length that is greater than the length of elongate cuts 17 and opening 16 in the top of container 10. This length prevents core 44 from inadvertently pulling out from box 11.

Core 44 is preferably made of wood-based products that can include cardboard, paper and/or wood composite recyclable materials. Alternatives include, for example adjoining plates connected by tape or other forms of hinge type rotating or flexing connections that can include polymer, metal or composite materials. Core 44 preferably has a square cross-section perpendicular to the longitudinal axis, but it is understood that core 44 can be a tube or take other forms such as a framework that functions to provide a core element for the connection, storage and dispensing of bags.

Figure 16:
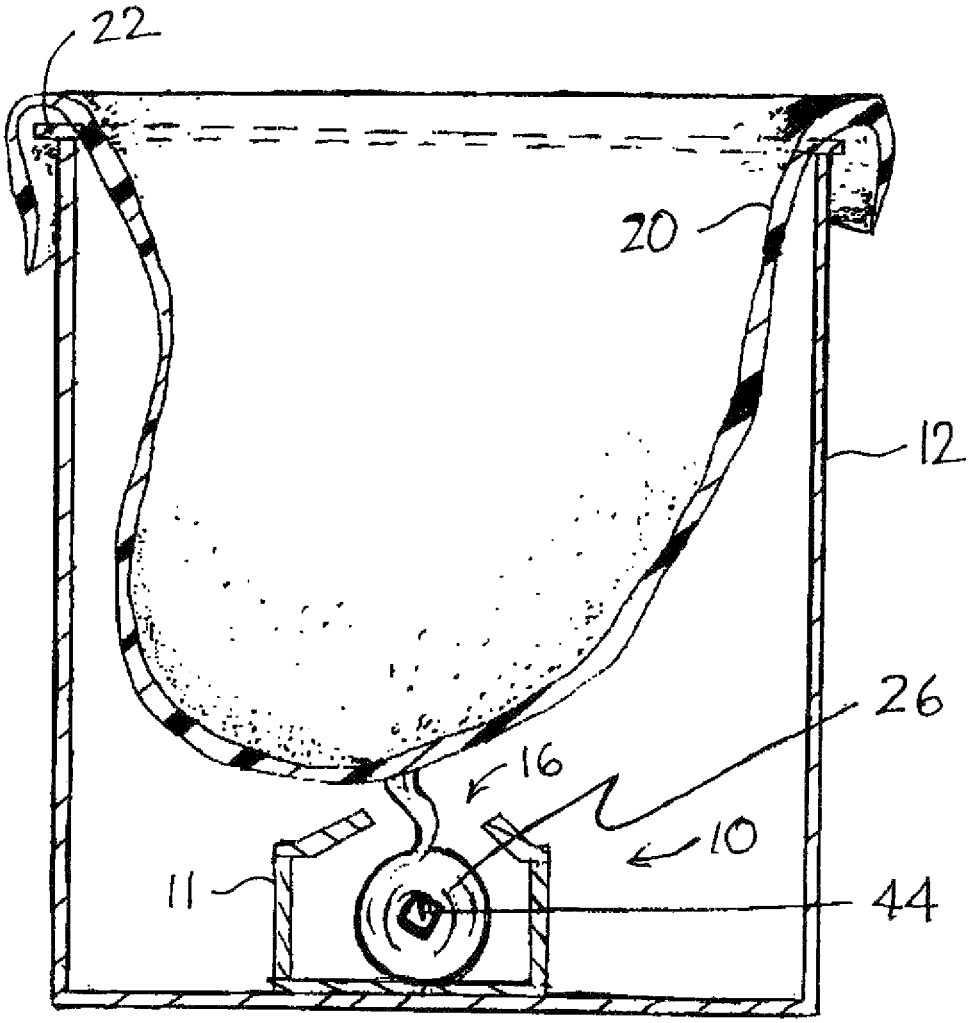
FIG. 16 is an idealized representation of a cross-sectional side view of the container of trash bags of FIG. 7 resting at the bottom of an exemplary trashcan, a bag is deployed from the container.

FIG. 16. Container 10 in operational use is positioned on the bottom of trashcan 12. This can include the partial deployment of bag 20 from opening 16 while box 11 of container 10 is dropped into trashcan 12. The opening of bag 20 is positioned around lid or edge 22 of trashcan 12. As described previously, container 10 is positioned directly on the bottom of trashcan 12 and uses neither adhesives nor any other form of device to retain container 10 on the bottom of trashcan 12.

Figure 17:
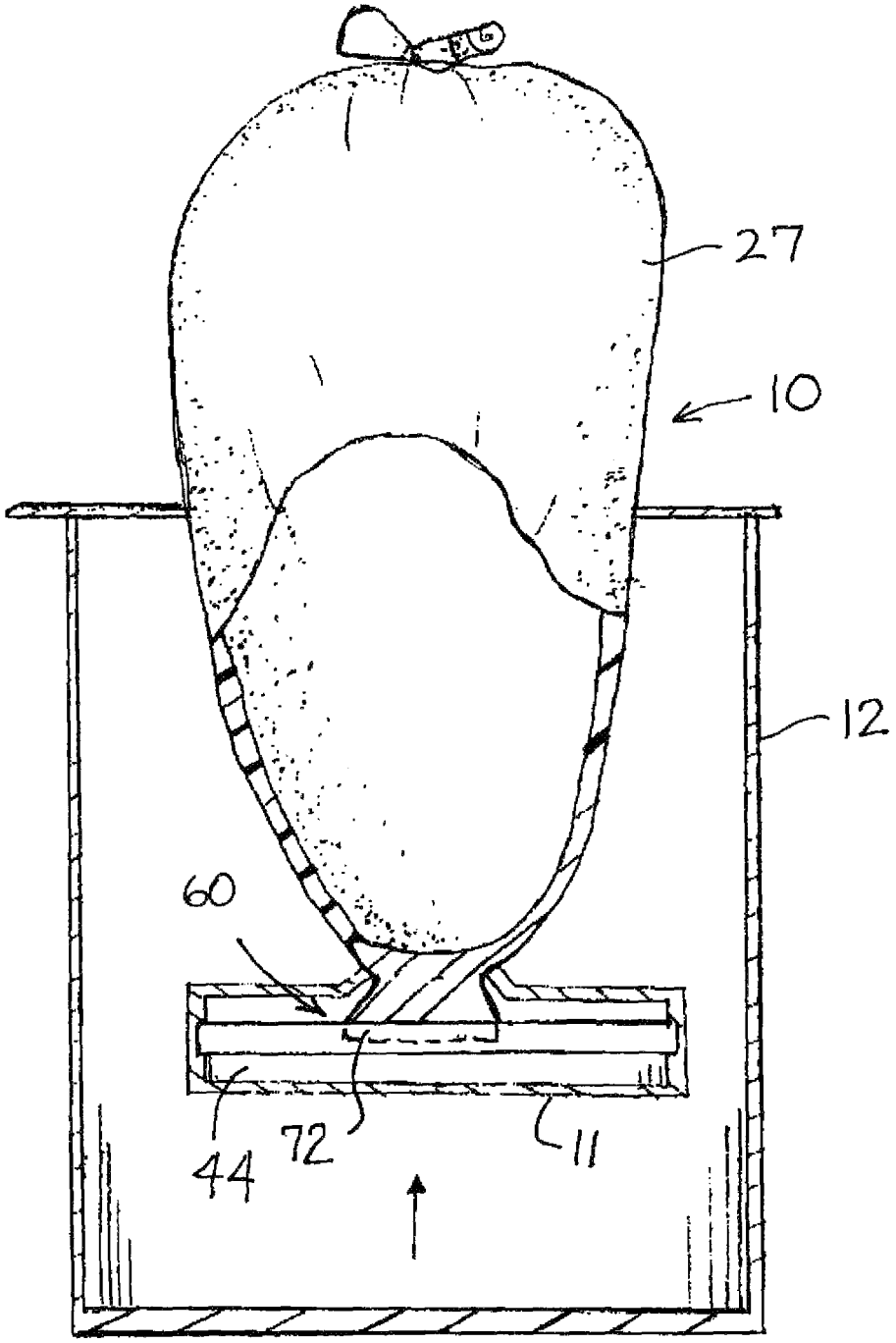
FIG. 17 is an idealized representation of a frontal view of the container of trash bags that includes a partial cross-section of the container of trash bags of FIG. 16 as the container is being removed from the trashcan with the last bag still attached to the core.

FIG. 17. When last bag 27 is removed from trashcan 12, box 11 and core 44 of container 10 are also removed. Core 44 provides crimp 60 with a sufficient bond such that when the last bag 27 is removed from trashcan 12, core 44 retains the connection with last bag 27.

Figure 18:
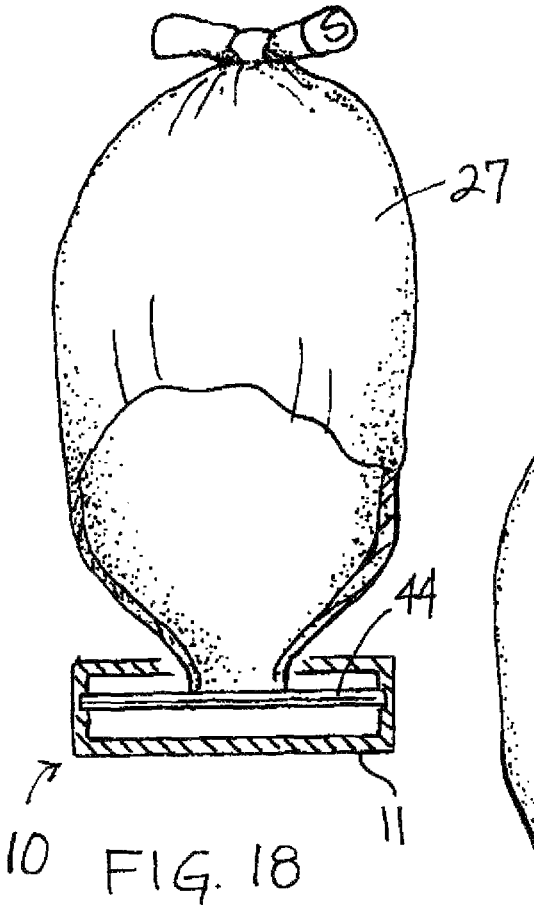
FIG. 18 is an idealized representation of the frontal view of the container of trash bags of FIG. 17 wherein the container and the last bag are still attached to the core.

FIGS. 15 and 18. Last bag 27 remains connected to and extends from core 44 in box 11 of container 10. Box 11 and core 44 can be recycled, discarded or refilled. Box 11 is preferably made of similarly recyclable material as core 44. Container 10 can be opened, core 44 removed and discarded or recycled and a series of bags 26 with core 44 positioned in connectors 74. Container 10 can then be closed to provide a secure enclosure for the retention of core 44 and series of bags 26.

Figure 19:
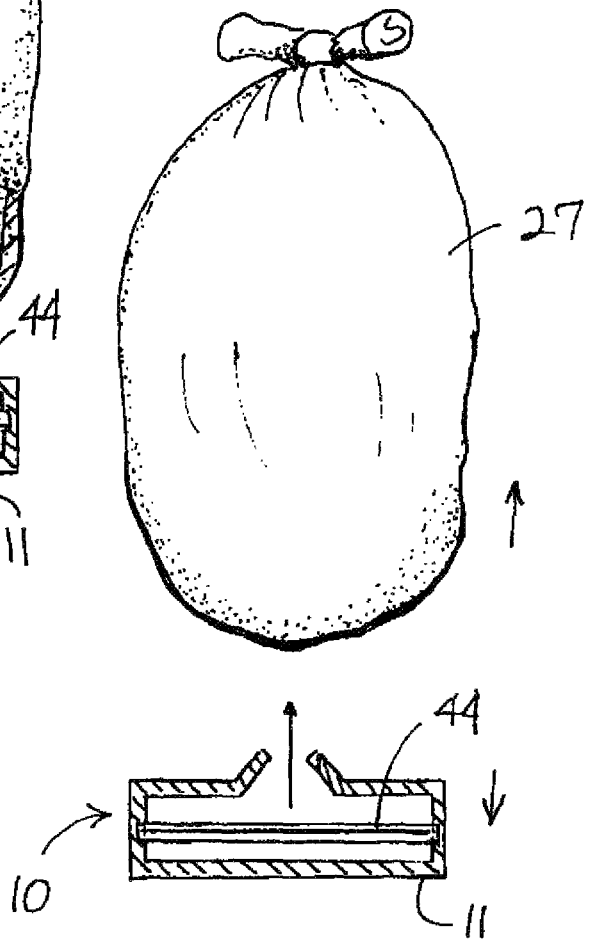
FIG. 19 is an idealized representation of the container of trash bags of FIG. 18 that shows the last bag separated from the core.

FIG. 19. Last bag 27 and core 44 remained connected until a predetermined level of force separates container 10 and bag 27. This level of force is preferably a simple additional gentle tug type motion. Core 44 remains connected to and/or positioned in box 11 after the separation of last bag 27.

Figure 20:
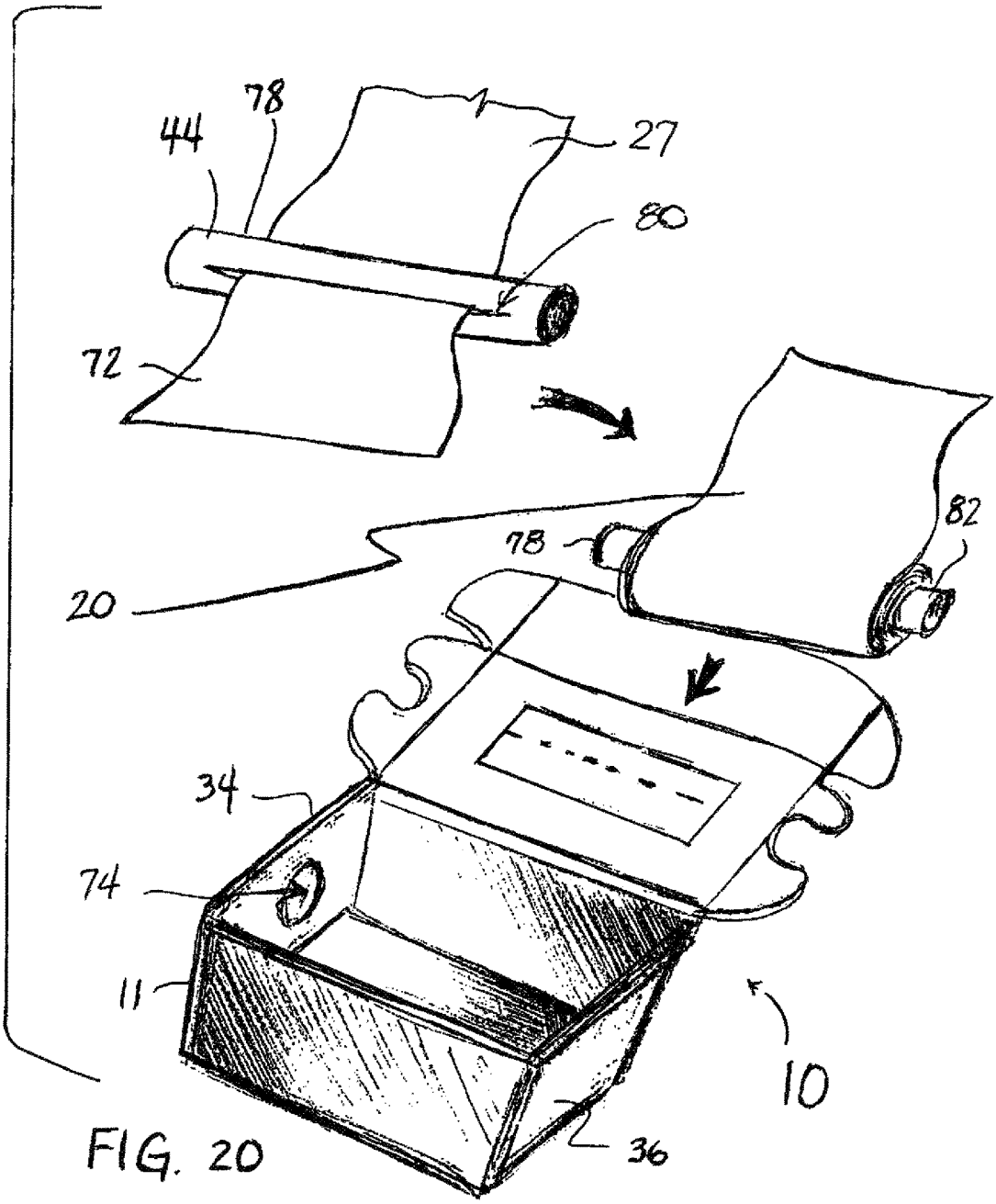
FIG. 20 is an exploded view of another embodiment of the series of bags of the container of trash bags of FIG. 1 that shows the container and a series of trash bags rolled on a spool.

FIG. 20. In another embodiment of series of bags 26, a spool 78 connects to the terminal end portion 72 of last bag 27. Spool 78 has a slit 80 parallel to the longitudinal axis (see FIG. 1) that receives at least a portion of terminal end portion 72 and functions to bind and retain last bag 27. The sequential bags from the last bag are wound around spool 78 to define series of bags 26. Box 11 defines connectors 74 in walls 34 and 36 as described previously and spool 78 has terminal end portions 82 that interface with connectors 72 for the rotation of series of bags 26 independent of box 11.

Figure 21:
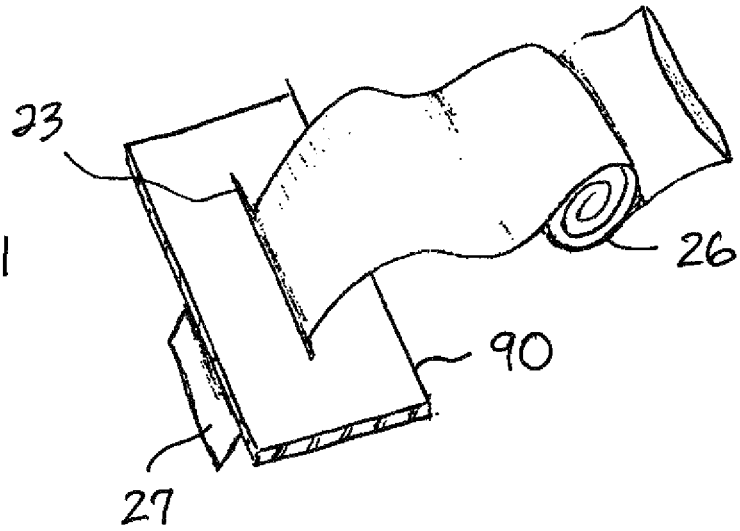
FIG. 21 is a top perspective view of a plate for the trash bags of FIG. 3.
Figure 22:
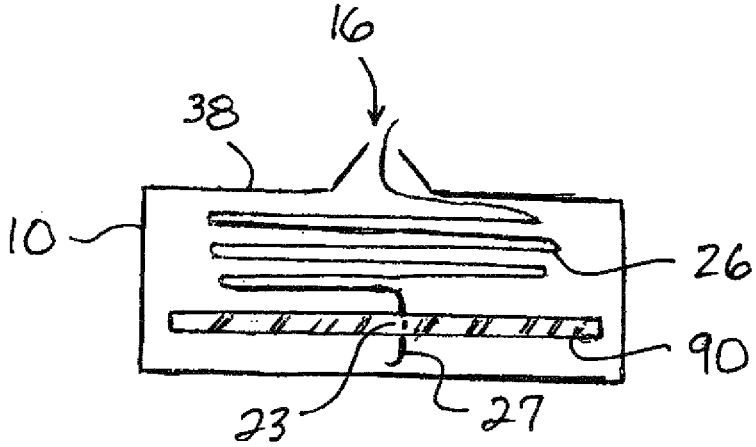
FIG. 22 is a side view of a plurality of folded trash bags and the plate positioned in an exemplary container.
Figure 23:
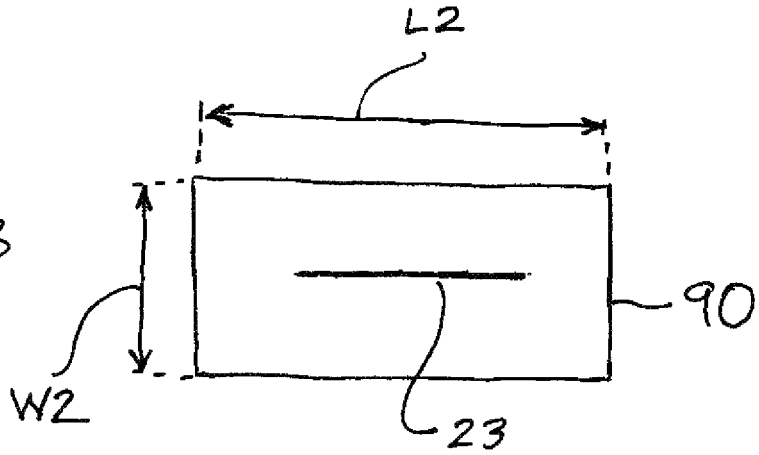
FIG. 23 is a top view of the exemplary container of FIG. 22 that shows a slot defined in a first wall of the container.

FIGS. 21-23. In a further embodiment of the present disclosure container holding the bags 10 includes a plate 90. Container 10 is preferably a box or package. Both container 10 and plate 90 are preferably made of recyclable materials such as for example cellulous or a recyclable polymer. Container 10 at least partially encloses plate 90 and a series of bags 26 that can be arranged in a roll, folded or any combination thereof.

Container 10 defines opening 16 in top 38 that has been expanded from perforations, pre-cut, weakened line or score 21. Opening 16 has a defined length L1 and a defined width W1 (See FIG. 7).

Plate 90 has a length L2, a width W2 and includes a cut 23. Length L2 and width W2 of plate 90 are greater than length L1 and width W1 of opening 16 of container 10, respectively. In one preferred embodiment, length L2 and width W2 of plate 90 approximate the dimensions of top 38, but it is understood that plate 90 can have a variety of shapes, sizes and thicknesses. Plate 90 retains the end of last bag 27 by the frictional binding force and/or bias of cut 23. Plate 90 has a structure that is sufficiently rigid such that plate 90 does not pass through opening 16. Similarly, slit or cut 23 has sufficient binding strength on the end of last bag 27 such that cut 23 will not readily release last bag 27.

Cut 23 of plate 90 is preferably parallel to the length of plate 90 and is a controlled slit such that when at least part of the end of last bag 27 of series of bags 26 is passed through cut 23, that portion of last bag 27 is retained by cut 23. Cut 23 retains bag 27 by the bias and/or frictional forces between the separated portions of plate 90.

Figure 24:
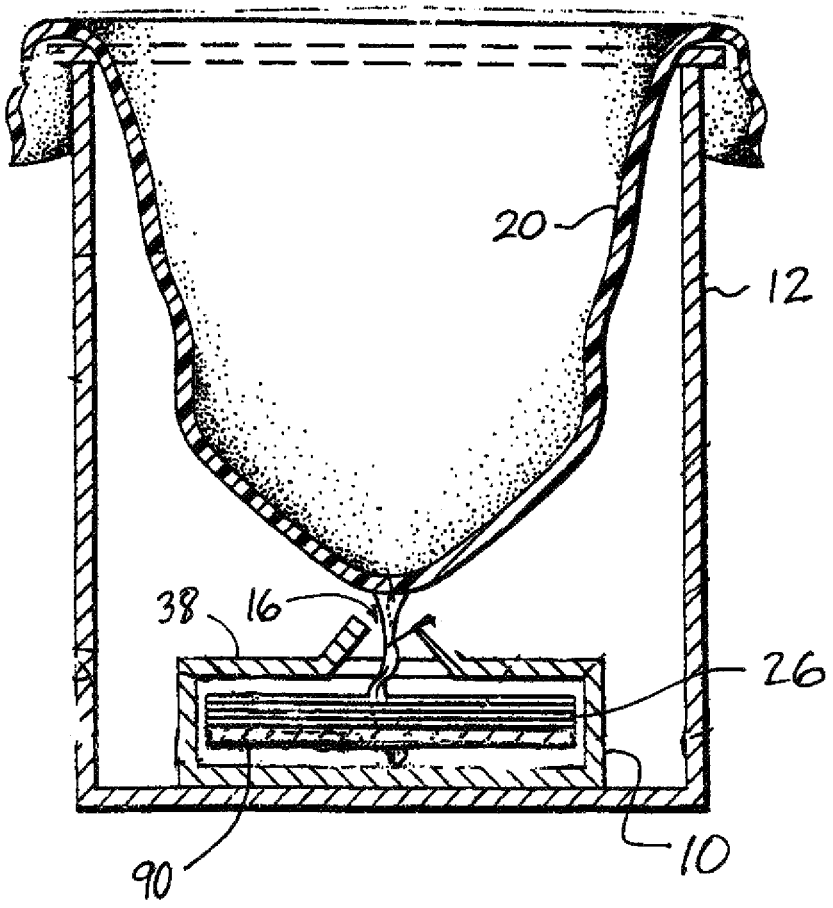
FIG. 24 is a side view of the plurality of garbage bags and plate with one of the garbage bags extended from the container, the garbage bag adapted for positioning in a trash can, the container and the remainder of the plurality of garbage bags adapted for being positioned at the bottom of the trash can while the garbage bag is extended from the container.

FIG. 24. Shows a deployed bag 20 connected to the series of bags 26 extending through opening 16 of top 38 of container 10 positioned in a bottom of a trash can 12. Last bag 27 extends through and is connected to plate 90. Plate 90 is positioned between last bag 27 of series of bags 26 and the inside bottom of container 10.

Figure 25:
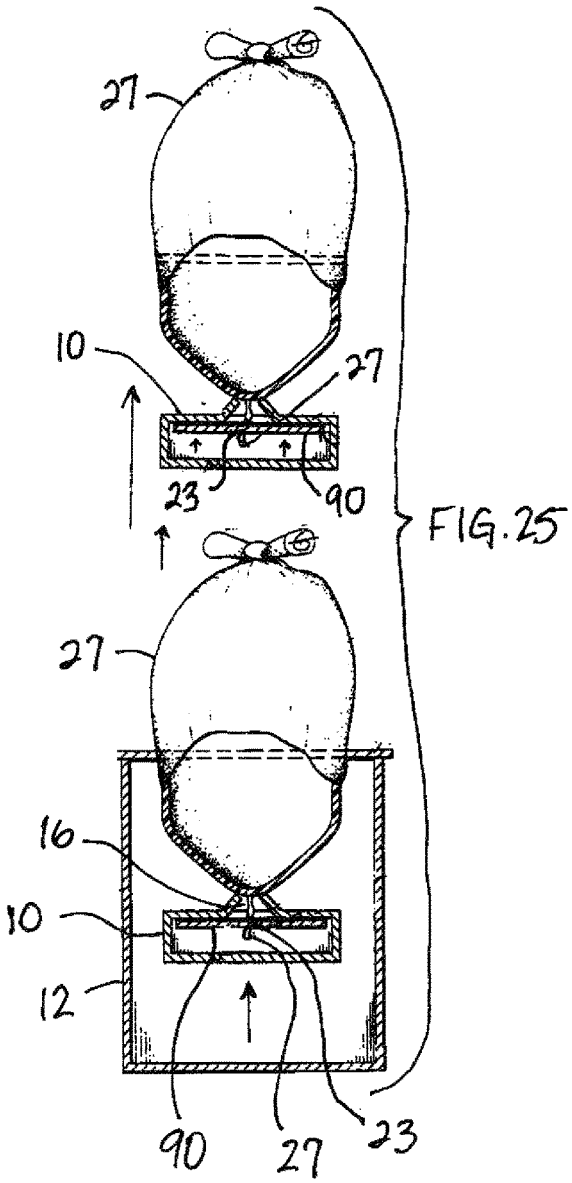
FIG. 25 is a side view of a last bag of the plurality of bags positioned in the container being withdrawn from a position at a bottom of the trash can with the container and plate.
Figure 28:
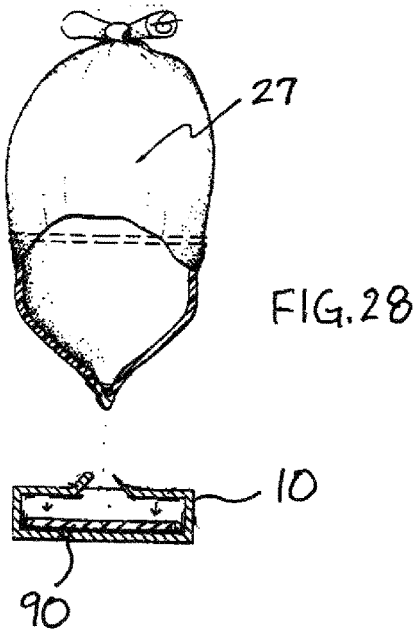
FIG. 28 is a side view of the last garbage bag of the plurality of garbage bags separated from the container and retention mechanism.
Figure 27:
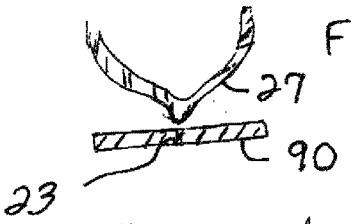
FIG. 27 is a close up side view of the last trash bag of the plurality of trash bags separated from the plate.
Figure 26:
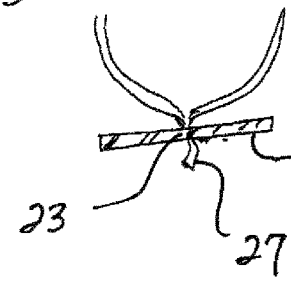
FIG. 26 is a close up side view of the last bag of the plurality of bags being retained by the plate.

FIGS. 24-25. The series of bags 26 eventually exhausts leaving last bag 27 as the final deployed bag. As last bag 27 is removed from trash can 12, the connection between plate 90 and last bag 27 is retained by cut 23 and plate 90 is pulled into contact with top 38 and opening 16 of container 10. The connection between cut 23 and the end of last bag 27 in combination with the dimensions and structural integrity of plate 90 prevents the release of last bag 27 from cut 23 and/or the passing of plate 90 through opening 16 of container 10. Plate 90 is constructed such that the weight of container 10 is not a sufficient load to deform plate 90 and pass plate 90 through opening 16.

FIGS. 25-28. Last bag 27 is preferably separated from cut 23 of plate 90 and container 10 by retaining container in a fixed position and applying a sufficient force that can range from a slow pull to a sharp jerk that pulls the end of last bag 27 through cut 23 of plate 90 and opening 16 of container 10. Last bag 27 is then discarded as trash. Container 10 and plate 90 being of similar recyclable materials can then be deposited into a recycling container appropriate for those materials.

In the preceding specification, the present disclosure has been described with reference to specific exemplary embodiments thereof. It will be evident, however, that various modifications, combinations and changes may be made thereto without departing from the broader spirit and scope of the invention as set forth in the claims that follow. While the present disclosure is described in terms of a series of embodiments, the present disclosure can combine one or more novel features of the different embodiments. The specification and drawings are accordingly to be regarded in an illustrative manner rather than a restrictive sense.

What is claimed is:

1. A bag dispensing apparatus comprising:

a container having a rectangular shape that includes a top, a bottom, two opposed first elongate sidewalls and two opposed second sidewalls, the second sidewalls having a length less than a length of the first elongate sidewalls, wherein the top defines an opening, and the container is made of a first recyclable material;

a plate positioned in the container, the plate sized to be larger than the opening, the plate defining a cut, and the plate having a length and a width, wherein the cut is a single slit, and the cut is parallel to the length of the plate, and wherein the plate is made of the first recyclable material;

a series of garbage bags connected in sequence and positioned in the container, wherein an end of a last bag of the series of garbage bags extends at least partially through the cut in the plate, the cut binds the last bag of the series of bags at least partially through the cut in the plate, and the cut binds an end of the last bag of the series of bags, wherein the container is adapted to be positioned in a bottom of a trash can, wherein when the last bag has completed its deployment in the trash can, the plate and container are adapted to be pulled from the trash can with the last bag, the cut in the plate has sufficient frictional binding force to retain the connection with the end of the last bag and the plate has sufficient structural rigidity that the plate is unable to pass through the opening in the top of the container, the last bag connected to the plate in the container is removed from the trash can; and wherein the last bag is separated from the container, the the separation of the last bag from the container including retaining the container and applying sufficient pulling force to overcome the binding force between the end of the last bag and the cut in the plate and pulling the last bag from the container, the application of the pulling force overcoming the binding force between the end of the last bag and the cut in the plate and separating the last bag from the cut in the plate and pulling the last bag through the opening in the top of the container, the plate retained in the container and the container and plate separated from the last bag.

2. The bag dispensing apparatus of claim 1, wherein the opening in the container is defined by cuts in the top of the container, the cuts defining hinged doors in the top of the container.

3. The bag dispensing apparatus of claim 1, wherein the series of bags are folded bags.

4. The bag dispensing apparatus of claim 1, wherein the series of bags is a roll of bags.

5. The bag dispensing apparatus of claim 1, wherein the first recyclable materials of the container and the plate are recyclable cellulose materials.

6. The bag dispensing apparatus of claim 1, wherein the container has a rectangular box shape, the plate has a length and a width that approximates the length and width of the top of the container, the cut consists of a single slit in the plate and the slit is parallel to the length of the plate.

7. The bag dispensing apparatus of claim 1, wherein the deployment of the last bag in the trash can includes the plate binding the end of the last bag when the last bag is full.

8. The bag dispensing apparatus of claim 1, wherein the plate is rigid.

9. The bag dispensing apparatus of claim 1, wherein the cut is a controlled cut, the controlled cut structured to retain at least a portion of the end of the last bag positioned in the cut in the plate by frictional binding force and retains the connection between the last bag and plate in the container when the last bag is removed from the trash can, the controlled cut structured to release the end of the last bag positioned in the cut when sufficient pulling force is applied between the last bag and the container.

10. The bag dispensing apparatus of claim 1, wherein the first recyclable materials of the container and the plate are recyclable polymer materials.

11. The bag dispensing apparatus of claim 1, wherein the structural rigidity of the plate prevents the release of the last bag from the cut and the passing of the plate through the opening in the container until the container is retained in a fixed position and the application of sufficient force to the bag to pull the end of the last bag through the cut in the plate and the opening in the container.

12. The bag dispensing apparatus of claim 1, wherein the container is held in position and the application of additional pulling force separates the last bag from the cut in the plate and pulls the last bag through the opening in the container.

13. A bag dispensing apparatus comprising:

a container having a rectangular shape that includes a top, a bottom, two opposed first elongate sidewalls and two opposed second sidewalls, the second sidewalls having a length less than a length of the first elongate sidewalls, wherein the top defines an opening, and the container is made of a first recyclable material;

a plate positioned in the container, the plate having a width and a length that approximates the length and width of the top of the container, the width and length of the plate sized to be larger than the opening in the top of the container, wherein the plate is sufficiently rigid that the plate does not pass through the opening, wherein the plate defines a single slit, the slit is parallel to the length of the plate, and the slit a controlled slit, and wherein the plate is made of the first recyclable material;

a series of garbage bags connected in sequence and positioned in the container, wherein at least a portion of an end of a last bag of the series of garbage bags extends at least partially through the slit in the plate, the slit binds the last bag of the series of bags at least partially through the slit in the plate, the slit binds an end of the last of the series of bag, wherein the container is adapted to be positioned in a bottom of a trash can, wherein when the last bag has completed its deployment in the trash can, the plate and container are adapted to be pulled from the trash can with the last bag, wherein a frictional binding force of the controlled slit in the plate retains the connection between the plate and the at least a portion of the end of the last bag, and the plate is unable to pass through the opening in the top of the container when the last bag is removed, wherein the controlled slit releases the end of the last bag upon the application of additional pulling force to the last bag, the application of additional pulling force separates the last bag from the controlled slit in the plate and pulls the last bag through the opening in the top of the container, the plate is retained in the container and the container and plate separated from the last bag.

14. The bag dispensing apparatus of claim 13, wherein the series of bags are folded bags.

15. The bag dispensing apparatus of claim 13, wherein the series of bags is a roll of bags.

16. The bag dispensing apparatus of claim 13, wherein the first recyclable material of the container and the plate are recyclable cellulose materials and can be recycled together.

17. The bag dispensing apparatus of claim 13, wherein the plate has a length and a width that approximates the length and width of the top of the container.

18. The bag dispensing apparatus of claim 13, wherein the first recyclable material of the container and the plate are recyclable polymer materials.

19. The bag dispensing apparatus of claim 13, wherein the plate retains the end of the last bag positioned in the slit in the plate by frictional binding force and the rigidity of the plate.

20. The bag dispensing apparatus of claim 13, wherein the container is held in position and the application of additional pulling force to the last bag separates the last bag from the slit in the plate and pulls the last bag through the opening in the top of the container, the plate retained in the container.

* * * * *